US007104845B2

(12) United States Patent
Higuchi et al.

(10) Patent No.: US 7,104,845 B2
(45) Date of Patent: Sep. 12, 2006

(54) ELECTRICAL JUNCTION BOX FOR A MOTOR VEHICLE

(75) Inventors: Eiji Higuchi, Yokkaichi (JP); Masashi Kanazawa, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 11/000,421

(22) Filed: Dec. 1, 2004

(65) Prior Publication Data

US 2005/0150676 A1 Jul. 14, 2005

(30) Foreign Application Priority Data

Dec. 24, 2003 (JP) ..... 2003-427631
Jul. 31, 2004 (JP) ..... 2004-247558

(51) Int. Cl.
*H01R 33/95* (2006.01)

(52) U.S. Cl. ..... 439/621; 439/949

(58) Field of Classification Search ..... 439/621, 439/949, 212, 213, 76.2, 507
See application file for complete search history.

(56) References Cited

U.S. PATENT DOCUMENTS 3,132,203 A * 5/1964 Ecker ..... 174/102 R
5,286,999 A * 2/1994 Chiu ..... 257/666
6,396,380 B1 5/2002 Girke et al.
6,396,390 B1 5/2002 Achhammer et al. .... 340/10.33
6,456,188 B1 9/2002 Tsuchiya ..... 337/235

FOREIGN PATENT DOCUMENTS

JP 10-174254 * 6/1998
JP A 10-247450 9/1998

* cited by examiner

*Primary Examiner*—Javaid H. Nasri
(74) *Attorney, Agent, or Firm*—Oliff & Berridge, PLC

(57) ABSTRACT

An electrical junction box for a motor vehicle includes a casing, a pair of bus bars accommodated in and secured to the casing with the bus bars being exposed outward, and a fusible link having a link body, an input terminal and an output terminal that extend from the opposite sides of the link body. The input and output terminals are secured to the bus bars by bolts, respectively. The input and output terminals of the fusible link are provided on the opposite side edges with ribs, respectively. Folding the bus bars forms U-bend portions to contact with outer side surfaces of the ribs. Alternatively, portions that contact side edges of the input and output terminals may be provided on inner surfaces of the casing.

11 Claims, 11 Drawing Sheets

ELECTRICAL JUNCTION BOX FOR A MOTOR VEHICLE

BACKGROUND OF THE INVENTION

This invention relates to an electrical junction box for a motor vehicle and more particularly relates to the junction box that can prevent breakage of a terminal of a fusible link and a link body when the fusible link is secured by a bolt to a bus bar accommodated in a casing of the electrical junction box.

For convenience of explanation, a conventional electrical junction box for a motor vehicle will be described by referring to FIGS. 11A, 11B, and 12. FIG. 11A is a plan view of a conventional electrical junction box. FIG. 11B is a longitudinal section view of the junction box taken along line I2—I2 in FIG. 11A. FIG. 12 is a plan view of another conventional fusible link.

The present applicant has previously proposed an electrical junction box 1 shown in FIGS. 11A and 11B. Patent Public Disclosure No. HEI 10-174254 (1998) discloses the electrical junction box 1 in which terminals of a fusible link are secured by a bolt to bus bars made of a conductive metal plate in a casing. The electrical junction box 1 has a casing including an upper casing member 2 and a lower casing member 3. The casing accommodates an assembly in which a plurality of bus bars 4 and insulation plates 5 are piled on one after another. An end of the bus bar 4 extends to a lower part of a fusible link containing-section 2*a* provided on the upper casing member 2. The extending end of the bus bar 4 is provided on a given position with a bolt hole (not shown). On the other hand, a fusible link 6 to be accommodated in the fusible link containing-section 2*a* is provided on the opposite sides of a link body 7 with an input terminal 8 and an output terminal 9 having bolt holes (not shown), respectively. When the fusible link 6 is accommodated in the fusible link containing-section 2*a*, the bolt holes in the bus bars 4 and the bolt holes in the input and output terminals of the fusible link 6 are aligned coaxially with one another and joined by bolts B.

However, there is a problem that heat radiation of the bus bars is lowered in the above structure, since the link body of the fusible link 6 and the input and output terminals 8 and 9 cover the whole upper surface of the bus bars 4.

Accordingly, as shown in FIG. 12, a structure is proposed in which the fusible link containing-section 2*a* is enlarged and the bus bars 4 to be connected to the input and output terminals 8 and 9 of the fusible link 6 are exposed to enhance heat radiation.

However, in this structure, when the bolts B fasten the input and output terminals 8 and 9 of the fusible link 6 onto the bus bars 4, a turning force of the bolt B moves the input terminal 8 or the output terminal 9 in the turning direction of the bolt B, since the input and output terminals 8 and 9 of the fusible link 6 are not fixed in the turning direction. This may break joining parts between the link body 7 and the input and output terminals 8 and 9.

In view of the above problems, an object of the present invention is to provide an electrical junction box for a motor vehicle that can prevent degradation of heat radiation of bus bars connected to terminals of a fusible link and can prevent breakage of the terminals of the fusible link and a link body when fastening by bolts.

Still other objects and advantages of the invention will in part be obvious and will in part be apparent from the specification.

SUMMARY OF THE INVENTION

In order to achieve the above object, the present invention provides an electrical junction box for a motor vehicle comprising: a casing; a pair of bus bars accommodated in and secured to the casing with the bus bars being exposed outward; and a fusible link having a link body, an input terminal and an output terminal that extend from the opposite sides of the link body. The input and output terminals are secured to the bus bars by bolts, respectively. The input and output terminals of the fusible link are provided on their opposite side edges with ribs, respectively and U-bend portions are provided on the bus bars to contact with outer side surfaces of the ribs. The U-bend portions are formed by folding parts of the bus bars.

According to the above structure, since the U-bend portions that are formed by folding the bus bars contact with the outer side surfaces of the ribs standing on the side edges of the input and output terminals of the fusible link, the U-bend portions can prevent rotary movements of the input and output terminals of the fusible link when securing the input and output terminals to the bus bars by the bolts, thereby preventing breakage of the link body of the fusible link and the terminals joining the link body.

Preferably, the U-bend portions contact with the ribs of the input and output terminals near at the positions where a longitudinal end of each of the ribs contacts with the link body of the fusible link.

According to the above structure, since the U-bend portions contact with the input and output terminals of the fusible link at the positions where the terminals join the link body and the terminals are subject to the maximum loads, it is possible to prevent breakage of the link body of the fusible link and the terminals at the joining positions.

The words "the positions where the terminals join the link body" mean the positions near at the proximal ends of the terminals exposed from the link body.

The U-bend portions of the bus bars contact with one rib on one side edge of the input terminal and with the other rib on the other side edge of the output terminal, respectively. Alternatively, the U-bend portions of the bus bars may contact with both ribs on the opposite side edges of the input and output terminals.

It is possible to prevent rotary movements upon bolt fastening action between the input and output terminals and the bus bars, if the U-bend portions of the bus bars contact with one rib on one side edge of the input terminal and with the other rib on the other side edge of the output terminal, respectively. However, if the U-bend portions of the bus bars contact with both ribs on the opposite side edges of the input and output terminals, it is possible to surely prevent rotary movements of the input and output terminals and to surely prevent breakage of the input and output terminals.

It is also possible to temporarily position the fusible link in the casing before fastening the fusible link by means of the bolts by bring the U-bend portions of the bus bars into contact with the opposite side edges of the input and output terminals.

In more detail, the electrical junction box for a motor vehicle further includes a fusible link containing-section on the outer surface of the casing. The bus bars are provided with great area portions that engage with the inner surface of a peripheral wall of the fusible link containing-section. Each of the U-bend portions is formed by folding a part extending from each of the great area portions onto each great area portion. The bus bars are provided with bolt holes. The fusible link containing-section is provided on the bottom wall with bolt holes. Nuts are previously fixed around the bolt holes on the rear side of the bottom wall of the fusible link containing-section. Bolt holes provided in the input and output terminals of the fusible link, bolt holes in the bus bars, and bolt holes in the bottom wall are aligned coaxially with one another. A bolt is inserted into each set of the aligned bolt holes and fastened by a nut.

According to the above structure, it is possible to enhance heat radiation of the bus bars to be connected to the input terminal and the output terminal of the fusible link, since the bus bars are provided with the great area portions. It is also possible to prevent breakage of the terminals and link body upon bolt-fastening action, since the U-bend portions restrain the rotary movement of the input and output terminals.

In addition, the second invention provides an electrical junction box for a motor vehicle comprising: a casing; a pair of bus bars accommodated in and secured to the casing; and a fusible link having a link body, an input terminal and an output terminal that extend from the opposite ends of the link body. The input and output terminals are secured to the bus bars by bolts, respectively. U-bend portions are integrally provided on the inner surface of the casing so that the U-bend portions contact with side edges of the input and output terminals of the fusible link.

In the above structure, as in the case of the first invention, it is possible to prevent rotary movements of the input and output terminals of the fusible link by means of the U-bend portions provided on the casing accommodating the fusible link when securing the input and output terminals of the fusible link to the bus bars by the bolts, thereby preventing breakage of the link body of the fusible link and the terminals joining the link body.

As in the case of the first invention, it is preferable that the U-bend portions contact with proximal ends of the input and output terminals projecting from the link body of the fusible link. It is also preferable that the U-bend portions of the bus bars contact either with one side edge of the input terminal and with the other side edge of the output terminal, respectively or with the opposite side edges of the input and output terminals.

The structure in which the U-bend portions prevent the rotary movement of the input and output terminals of the fusible link includes the input terminal, the output terminal, and fusible portions that interconnect the input and output terminals in the link body and are arranged on the same plane as the input and output terminals. In this fusible link, the loads applied to the input and output terminals upon bolt-fastening action are directly transmitted to the fusible portions so that the fusible portions are readily broken. Accordingly, the U-bend portions can prevent the rotary movement of the input and output terminals and can surely prevent the fusible portions from being broken.

It will be apparent from the foregoing that according to the present invention, since the U-bend portions, which are formed by folding the bus bars or are provided integrally on the inner surface of the casing, contact with the side edges of the input and output terminals of the fusible link, the U-bend portions can prevent rotary movements of the input and output terminals of the fusible link when securing the input and output terminals to the bus bars by the bolts, thereby preventing breakage of the link body of the fusible link and the terminals joining the link body.

Furthermore, it is also possible to prevent breakage of the terminals and link body upon bolt-fastening action, since the U-bend portions restrain the rotary movement of the input and output terminals. At the same time, it is possible to enhance heat radiation of the bus bars to be connected to the input terminal or the output terminal of the fusible link, since the bus bars are provided with the great area portions to be exposed from the fusible link containing-section.

BRIEF DESCRIPTION OF THE DRAWINGS

The features of the present invention believed to be novel and the elements characteristic of the present invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE PREFERRED EMBODIMENTS

Figure 1:
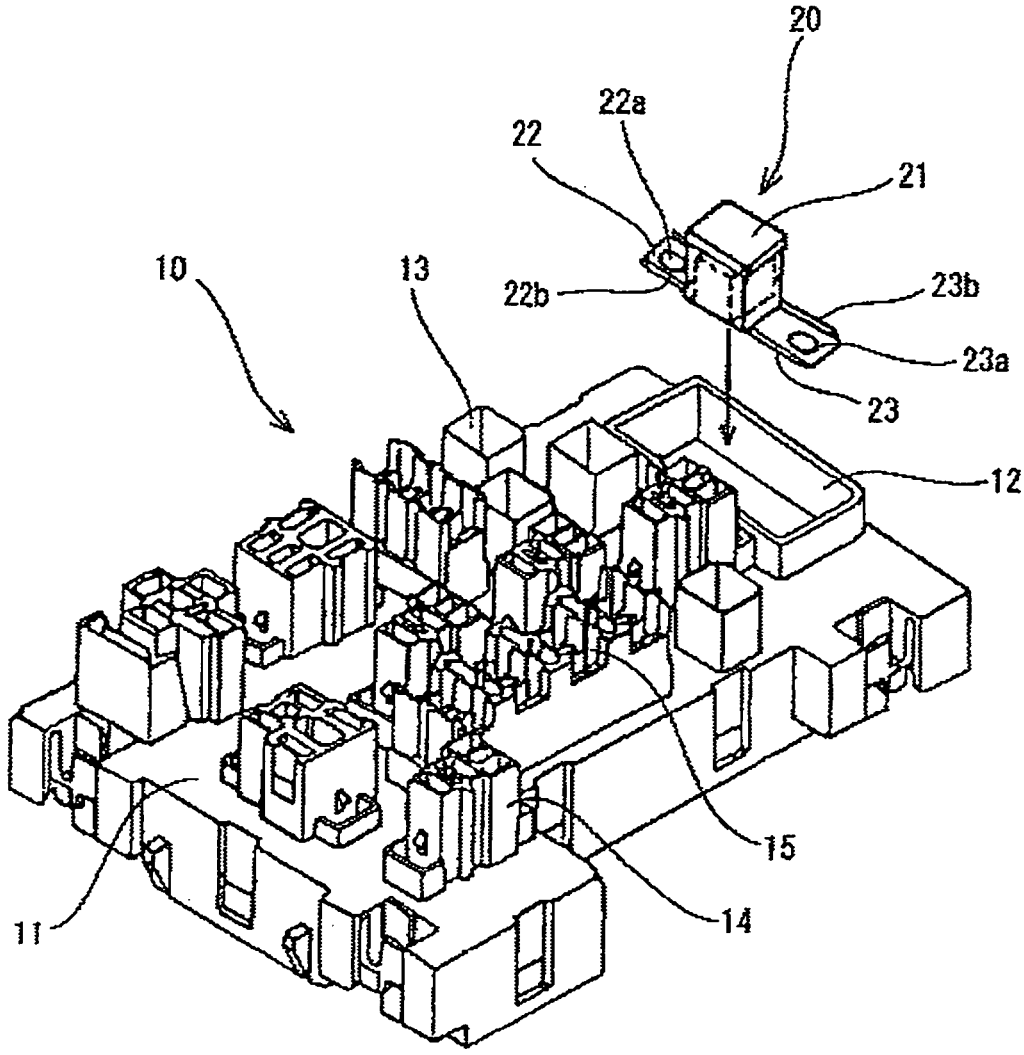
FIG. 1 is a perspective view of a first embodiment of an electrical junction box in accordance with the present invention.

In describing the preferred embodiments of the present invention, reference will be made herein to FIGS. 1 through 10B of the drawings in which like numerals refer to like features of the invention. Features of the invention are not necessarily shown to scale in the drawings.

By referring to the drawings, embodiments of an electrical junction box for a motor vehicle in accordance with the present invention will be described below.

FIGS. 1 through 5 show a first embodiment of an electrical junction box for a motor vehicle in accordance with the present invention.

As shown in FIG. 1, an electrical junction box 10 for a motor vehicle has a casing including an upper casing member 11 and a lower casing member (not shown). The upper casing member 11 is provided on the outer surface with a fusible link containing-section 12, a connector containing-section 13, a relay containing-section 14, and a fuse containing-section 15.

Figure 2A:
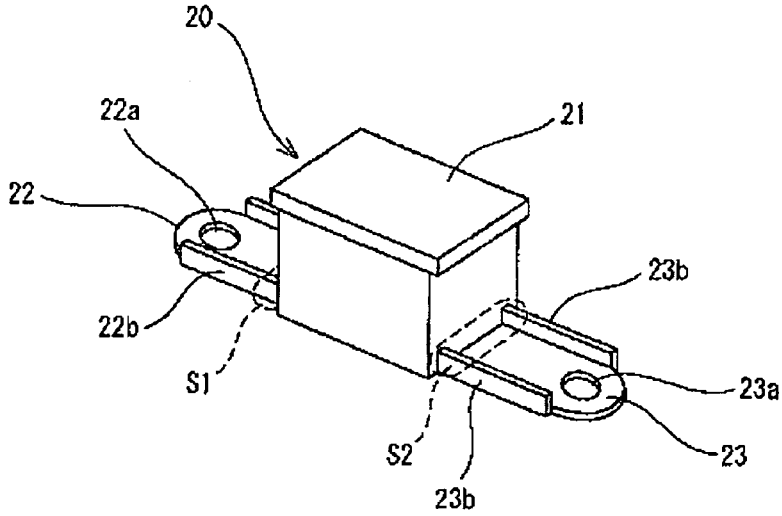
FIG. 2A is a perspective view of a fusible link.
Figure 2B:
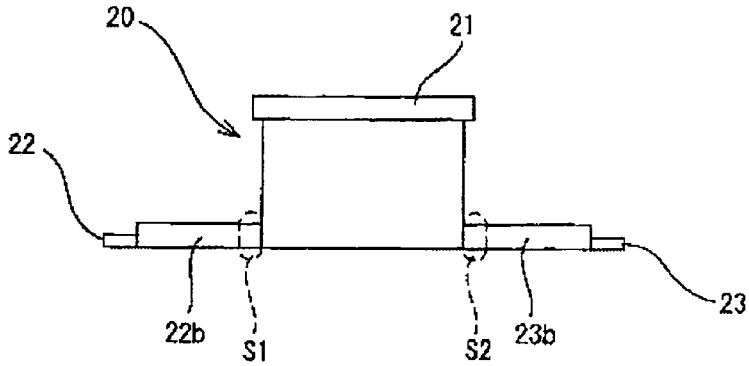
FIG. 2B is a front elevation view of the fusible link.
Figure 2C:
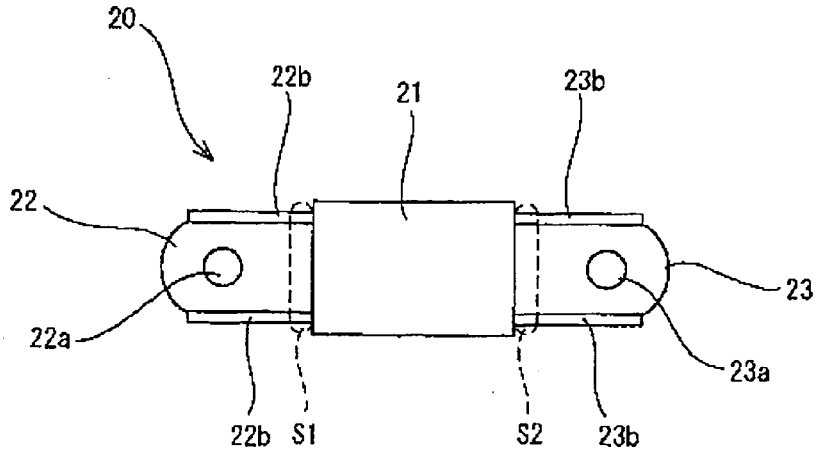
FIG. 2C is a plan view of the fusible link.

As shown in FIGS. 2A to 2C, a fusible link 20 to be accommodated in the fusible link containing-section 12 includes a link body 21, an input terminal 22 and an output terminal 23 that extend from the opposite sides of the link body, respectively. The input and output terminals 22 and 23 are provided on the ends with bolt holes 22*a* and 23*a* and on the opposite sides with ribs 22*b* and 23*b* extending upward, respectively.

Figure 3A:
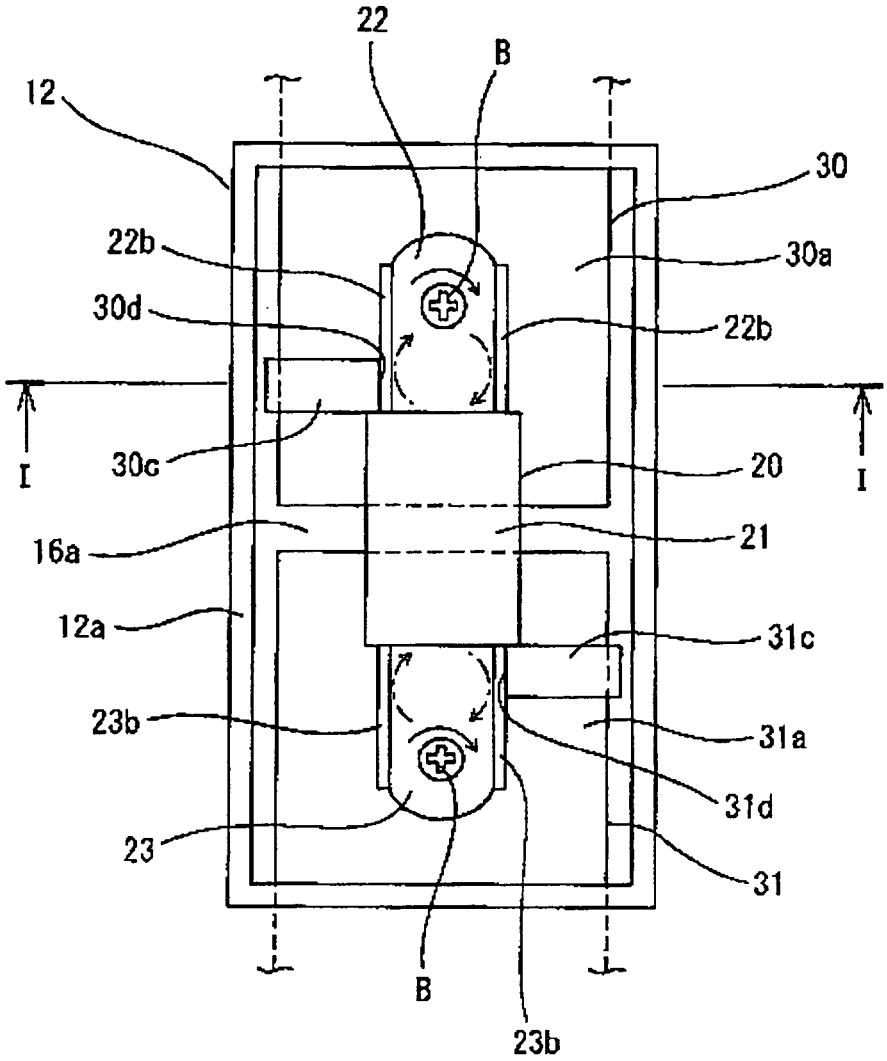
FIG. 3A is a plan view of a fusible link containing-section, illustrating a fusible link accommodated in the containing-section.
Figure 3B:
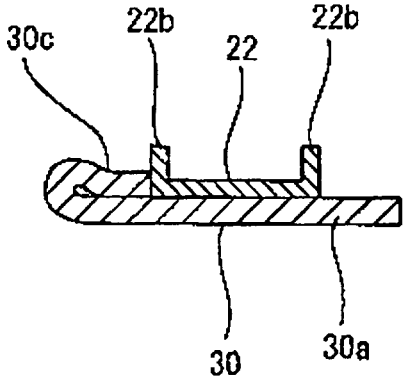
FIG. 3B is a cross section view of the fusible link containing-section taken along line I—I in FIG. 3A.

As shown in FIGS. 3A and 3B, the fusible link containing-section 12 for accommodating the fusible link 20 has a size greater than an outer size of the fusible link 20 and includes great area portions 30*a* and 31*a* that expose a pair of bus bars 30 and 31 within a peripheral wall 12*a* of the containing-section 12. The bus bars 30 and 31 are secured in the casing of the electrical junction box 10.

Figure 4A:
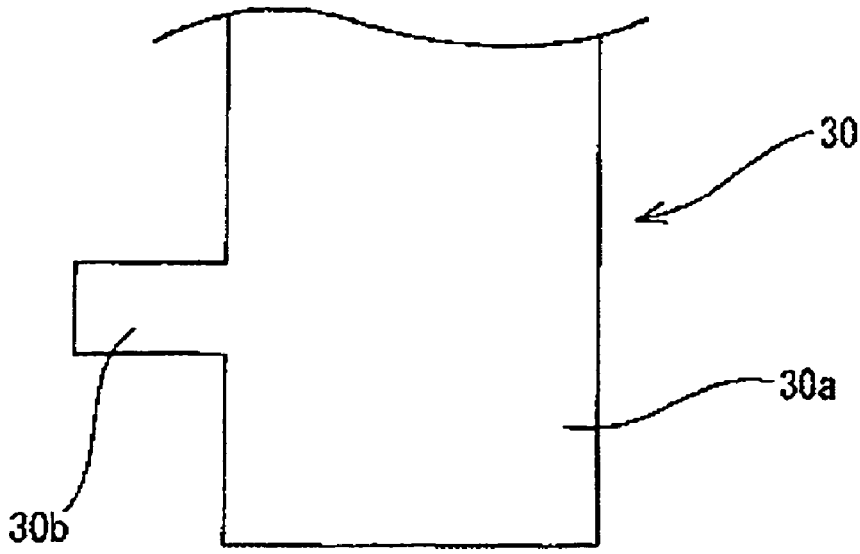
FIG. 4A is a plan view of a bus bar.
Figure 4B:
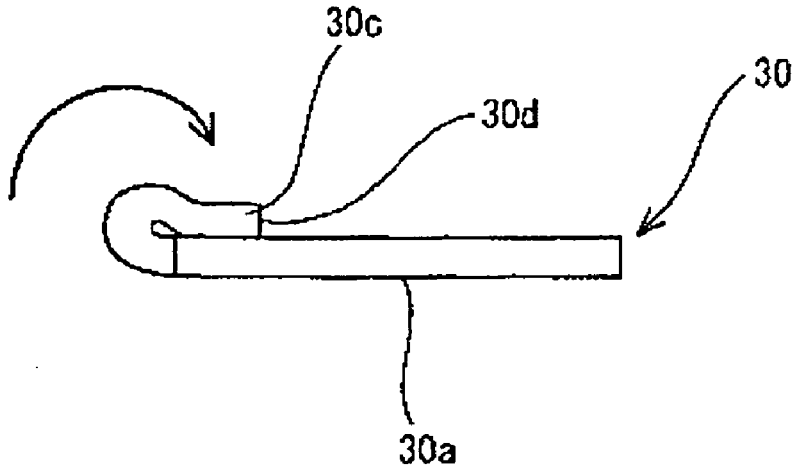
FIG. 4B is a side elevation view of the bus bar, illustrating a method for forming a U-bend portion.

As shown in FIG. 4A, a projection 30*b* is provided on one side (left side in the drawing) of the great area portion 30*a* to be connected to the input terminal 22 of the fusible link 20. As shown in FIG. 4B, the projection 30*b* is folded at the proximal end onto the great area portion 30*a* to form a U-bend portion 30*c*. A distal end 30*d* of the U-bend portion 30*c* is disposed at a position where the input terminal 22 joins the link body 21 when the fusible link 20 is secured to the bus bar 30 by the bolt, that is, a position where the distal end 30*d* contacts with the rib 22*b* on one side edge of the proximal end (region S1 enclosed by a broken line in FIGS. 2A to 2C) of the input terminal 22, the proximal end being opposite from the bolt hole 22*a*. A bolt hole 30*e* is provided at a given position in the great area portion 30*a* of the bus bar 30. Similarly, a U-bend portion 31*c* is provided on the other side (right side in FIG. 3A) of the great area 31*a* to be connected to the output terminal 23 of the fusible link 20. A distal end 31*d* of the U-bend portion 30*c* is disposed at a position where the output terminal 23 joins the link body 21, that is, a position where the distal end 31*d* contacts with the rib 23*b* on the other side edge of the proximal end (region S2 enclosed by a broken line in FIGS. 2A to 2C) of the output terminal 23, the proximal end being opposite from the bolt hole 23*a*. A bolt hole 31*e* is provided at a given position in the great area portion 31*a* of the bus bar 31. That is, the U-bend portions 30*c* and 31*c* are arranged diagonally with respect to the fusible link 20.

In the present embodiment, the rib 22*b* on "one side edge" of the input terminal 22 or the rib 23*b* on "the other side edge" of the output terminal 23 defines the side to which a load is applied in a direction moving away from the link body 21 (a direction indicated by arrows of alternate long and short dash lines in FIG. 3A) when the bolt B is turned to a direction shown by a full line arrow in FIG. 3A.

Figure 5:
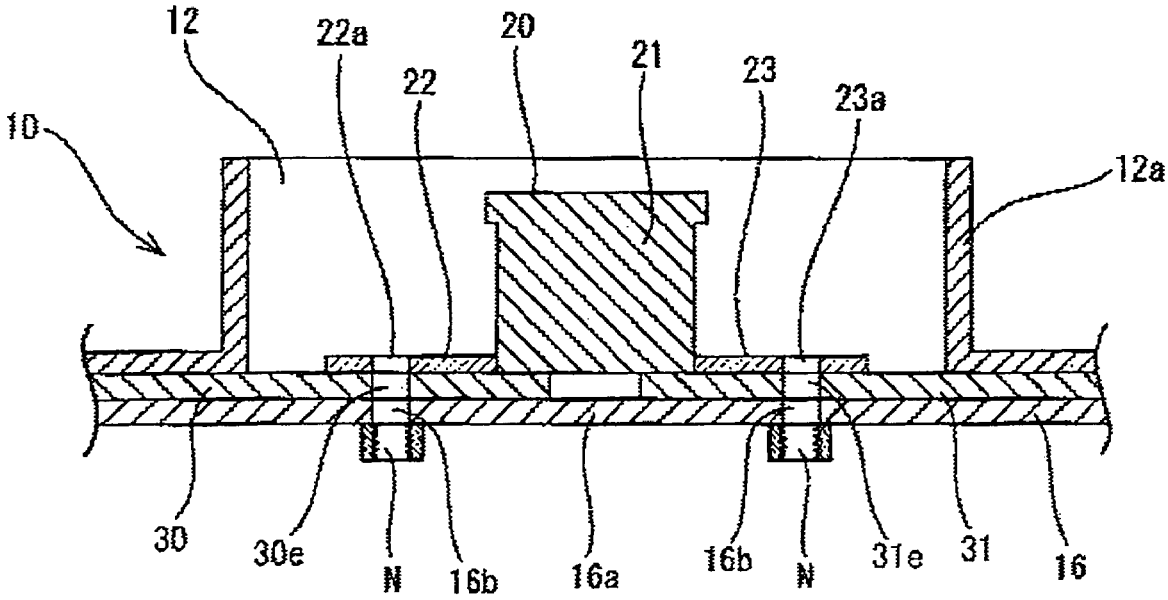
FIG. 5 is a longitudinal section view of the fusible link containing-section, illustrating the fusible link accommodated in the containing-section.

As shown in FIG. 5, a bottom wall 16*a* of the fusible link containing-section 12 includes an insulation plate 16 accommodated in the casing. Bolt holes 16*b* are provided at desired positions in the bottom wall 16*a* and nuts N are previously fixed around the bolt holes 16*b* on the rear side of the bottom wall 16*a*.

As shown in FIG. 3A, the fusible link 20 is accommodated in the fusible link containing-section 12 and the U-bend portions 30*c* and 31*c* of the bus bars 30 and 31 are brought into contact with the ribs 22*b* and 23*b* at the position where the input and output terminals 22 and 23 of the fusible link 20 join the link body 21. Then, as shown in FIG. 5, the bolt holes 22*a* and 23*a* in the input and output terminals 22 and 23 of the fusible link 20, the bolt holes 30*e* and 31*e* in the bus bars 30 and 31, and the bolt holes 16*b* in the bottom wall 16*a* are aligned coaxially with one another. The bolt B is inserted into the set of aligned bolt holes and fastened into the nuts N, thereby securing the input and output terminals 22 and 23 of the fusible link 20 to the great area portions 30*a* and 31*a* of the bus bars 30 and 31.

When the input and output terminals 22 and 23 of the fusible link 20 are secured to the bus bars 30 and 31 by fastening the bolts B in the direction indicated by the full line arrow in FIG. 3A, the input and output terminals 22 and 23 receive a first load in the direction moving away from the link body 21 (the direction indicated by the arrows of alternate long and short dash lines in FIG. 3A) and a second load in the direction moving toward the link body 21 (the direction indicated by the arrows of alternate long and two-short-dash lines in FIG. 3A). Accordingly, in the present embodiment, the U-bend portions 30*c* and 31*c* of the bus bars 30 and 31 are brought into contact with the ribs 22*b* and 23*b* of the input and output terminals 22 and 23 that receive the first load in the direction moving away from the link body 21, thereby preventing the input and output terminals 22 and 23 from being turned.

Since the U-bend portions 30*c* and 31*c* that are formed by folding the bus bars 30 and 31 contact with the outer side surfaces of ribs 22*b* and 23*b* standing on the side edges of the input and output terminals 22 and 23 of the fusible link 20 in the above structure, the U-bend portions 30*c* and 31*c* can prevent rotary movements of the input and output terminals 22 and 23 of the fusible link 20 when securing the input and output terminals 22 and 23 to the bus bars 30 and 31, thereby preventing breakage of the link body 21 of the fusible link 20 and the terminals joining the link body 21.

It is possible to enhance heat radiation of the bus bars 30 and 31 to be connected to the input and output terminals 22 and 23 of the fusible link 20, since the bus bars 30 and 31 are provided with the great area portions 30*a* and 31*a* to expose the area portions within the peripheral wall of the fusible link containing-section 12.

Although the ribs 22*b* and 23*b* are provided on the opposite side edges of the input and output terminals 22 and 23 of the fusible link 20 in the present embodiment, the ribs 22*b* and 23*b* may be provided on only the side edges that contact with the U-bend portions 30*c* and 31*c*.

Figure 6:
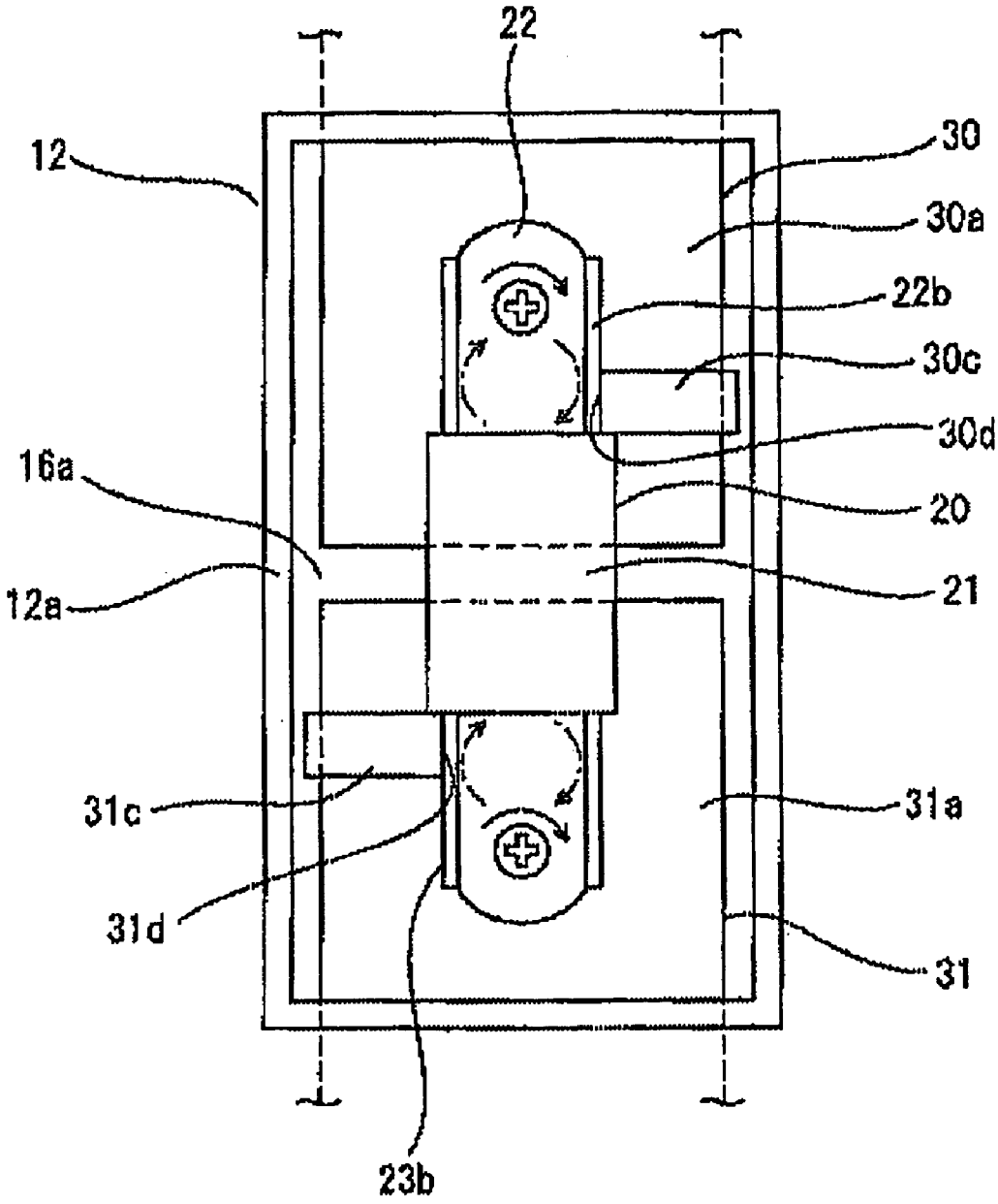
FIG. 6 is a plan view of a modification of the first embodiment in accordance with the present invention.

FIG. 6 shows a modification of the first embodiment. The U-bend portions 30*c* and 31*c* are provided on the bus bars 30 and 31 at the positions opposite from the U-bend portions 30*c* and 31*c* in the first embodiment, that is, on the sides to which the loads are applied to the link body 21 (the loads in the directions indicated by the arrows of the alternate long and two-short-dash lines in FIG. 6).

In the above structure, it is possible for the U-bend portions 30*c* and 31*c* to prevent rotary movements of the input and output terminals 22 and 23 of the fusible link 20 when securing the input and output terminals 22 and 23 of the fusible link 20 to the bus bars 30 and 31 by the bolts, thereby preventing breakage of the link body 21 of the fusible link 20 and the terminals joining the link body.

Since the other structures and operational effects of the modification are the same as those of the first embodiment, the same signs in the fist embodiment are given to the corresponding elements in the modification and the detail explanations of them are omitted.

Figure 7:
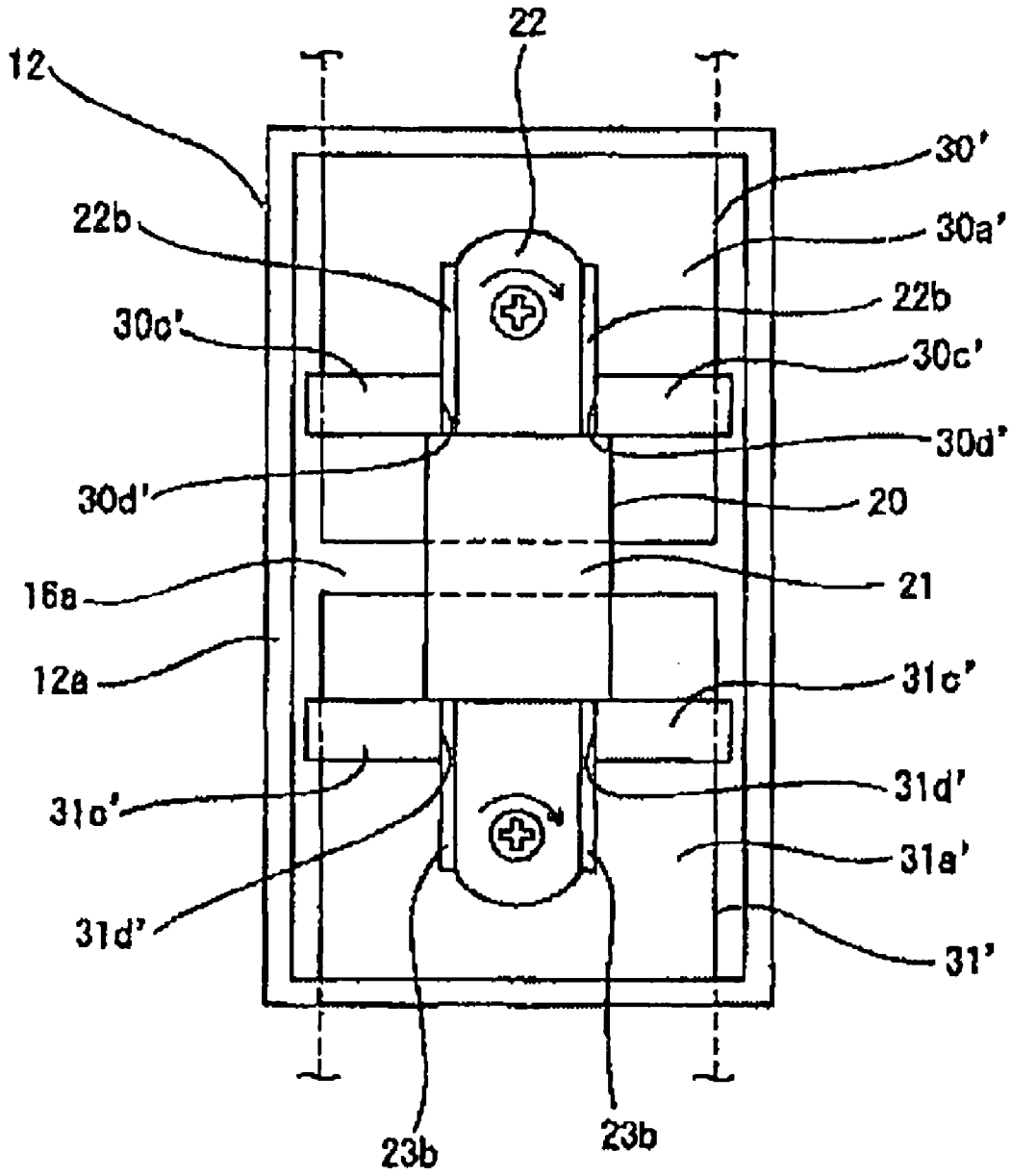
FIG. 7 is a plan view of a second embodiment of an electrical junction box for a motor vehicle in accordance with the present invention.
Figure 8:
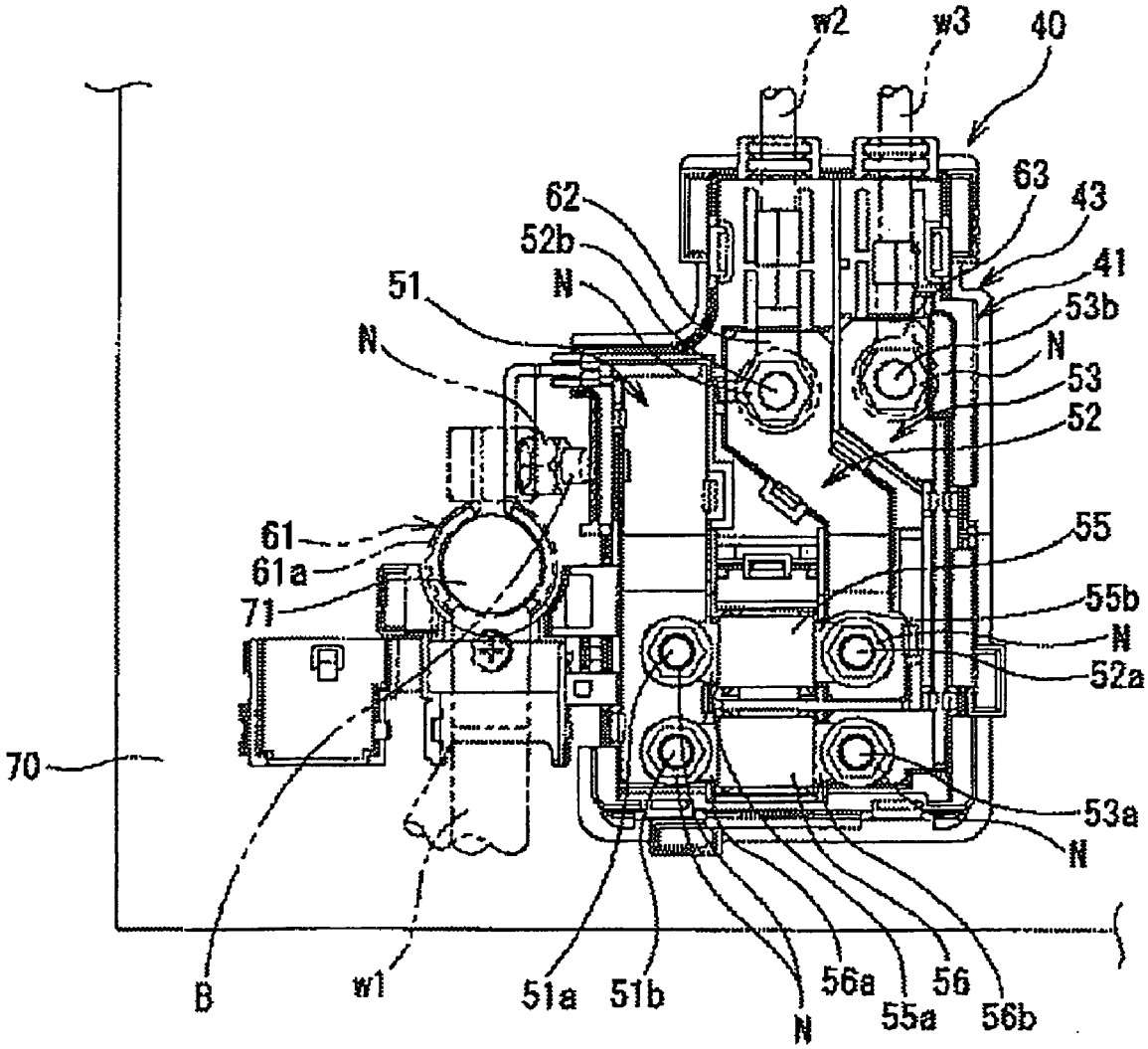
FIG. 8 is a plan view of a third embodiment of an electrical junction box for a motor vehicle in accordance with the present invention, illustrating the box from which an upper cover is removed.

FIG. 7 shows a second embodiment of an electrical junction box for a motor vehicle in accordance with the present invention. U-bend portions 30*c*' and 31*c*' are provided on the opposite sides of the bus bars 30' and 31'. The distal ends 30*d*' and 31*d*' of the U-bend portions 30*c*' and 31*c*' are disposed at positions where the ribs 22*b* and 23*b* of the input and output terminals 22 and 23 contact with the link body 21, that is, positions where the distal ends 30*d*' and 31*d*' contact with the proximal ends of the input and output terminals 22 and 23 (regions S1 and S2 enclosed by broken lines in FIGS. 2A to 2C), the proximal ends being opposite from the bolt holes 22*a* and 23*a*.

The U-bend portions 30*c*' and 31*c*' in the above structure can prevent rotary movements of the input and output terminals 22 and 23 of the fusible link 20 when securing the input and output terminals 22 and 23 to the bus bars 30' and 31', thereby preventing breakage of the link body 21 of the fusible link 20 and the terminals joining the link body.

It is also possible to temporarily position the fusible link 20 by the U-bend portions 30*c*' and 31*c*' before the fusible link 20 is secured to the bus bars 30' and 31'.

Since the other structures and operational effects in the second embodiment are the same as those of the first embodiment, the same signs in the fist embodiment are given to the corresponding elements in the second embodiment and the detail explanations of them are omitted.

FIG. 8 through FIG. 10B show a third embodiment of an electrical junction box for a motor vehicle in accordance with the present invention.

An electrical junction box 40 in the third embodiment includes a fuse box disposed on a battery box 70 in an engine compartment in a motor vehicle.

The electrical junction box 40 includes a casing body 41, a plurality of bus bars 51, 52, 53 disposed in the casing body 41, two fusible links 55, 56 connected to the bus bars 51 to 53, an upper cover (not shown) mounted on the casing body 41, and a lower cover 43 mounted on the casing body 41.

In more detail, a single input side bus bar 51 and two output side bus bars 52, 53 are disposed on the top surface of the casing body 41. An input terminal 55*a* of the fusible link 55 and an input terminal 56*a* of the fusible link 56 are engaged with bolts 51*a*, 51*b* projecting from an end of the input side bus bar 51 and huts N fasten the bolts 51*a*, 51*b*. An output terminal 55*b* of the fusible link 55 is engaged with a bolt 52*a* on an end of the output side bus bar 52 while an output terminal 56*b* of the fusible link 56 are engaged with bolts 53*a* on an end of the output side bus bar 53. Nuts N fasten the bolts 52*a*, 53*a*.

Figure 9:
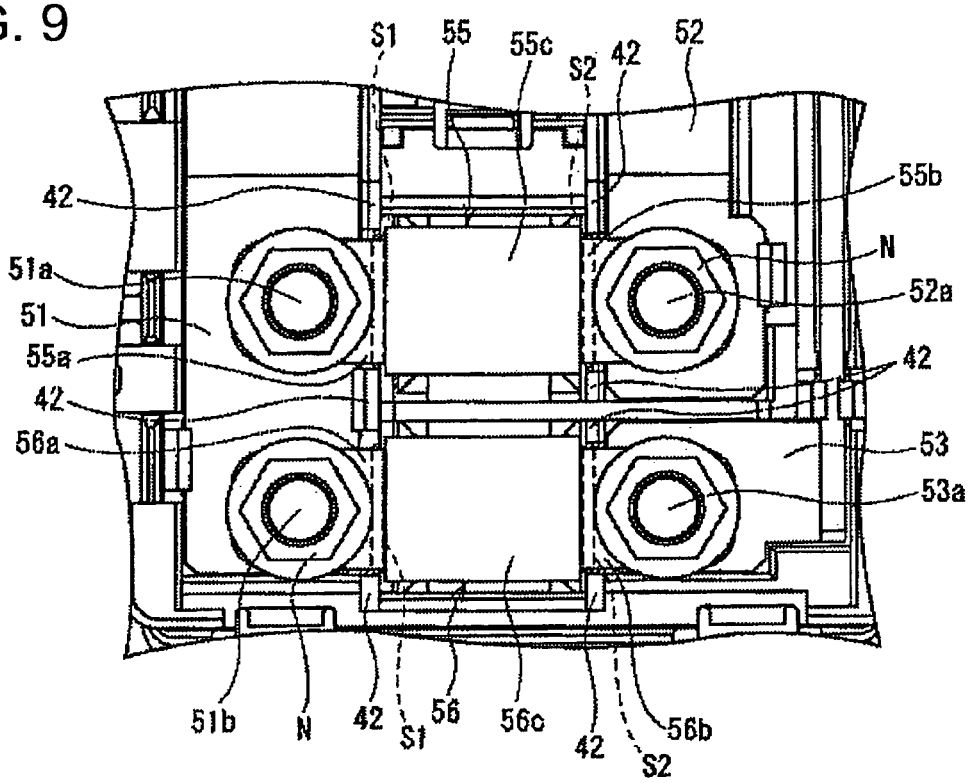
FIG. 9 is an enlarged plan view of a main part of a fusible link, illustrating an attachment position of the fusible link.

As shown in FIG. 9, a plurality of U-bend portions 42 are integrally provided on the inner surface of a bottom wall of the casing body 41. The U-bend portions 42 contact with the input terminals 55*a* and 56*a* projecting from the link bodies 55*c* and 56*c* of the fusible links 55 and 56 and with side edges of projecting proximal portions of the output terminals 55*b* and 56*b* (regions S1 and S2 enclosed by broken lines in FIG. 9). As in the case of the first embodiment, when the fusible links 55 and 56 are secured to the bus bars 51, 52, 53 by fastening the nuts N, the U-bend portions 42 can prevent rotary movements of the input and output terminals 55*a*, 56*a* and 55*b*, 56*b* of the fusible links 55 and 56.

Figure 10A:
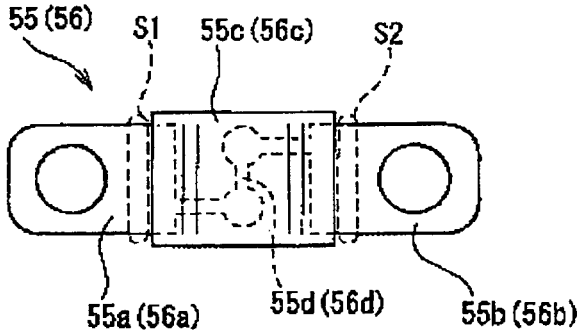
FIG. 10A is a plan view of a fusible link to be accommodated in the third embodiment of the electrical junction box.
Figure 10B:
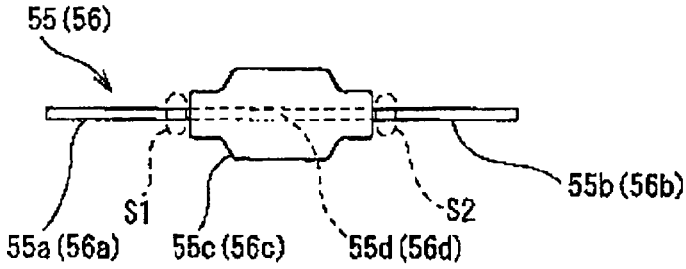
FIG. 10B is a front elevation view of the fusible link.
Figure 11A:
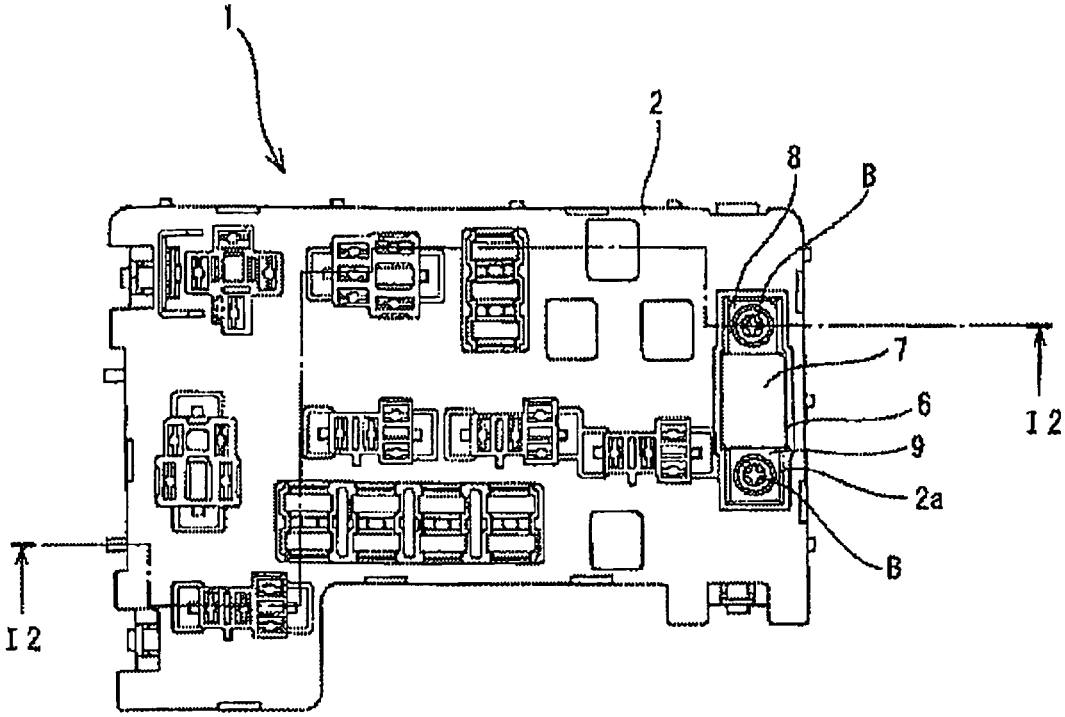
FIG. 11A PRIOR ART
FIG. 11A is a plan view of a conventional electrical junction box.
Figure 11B:
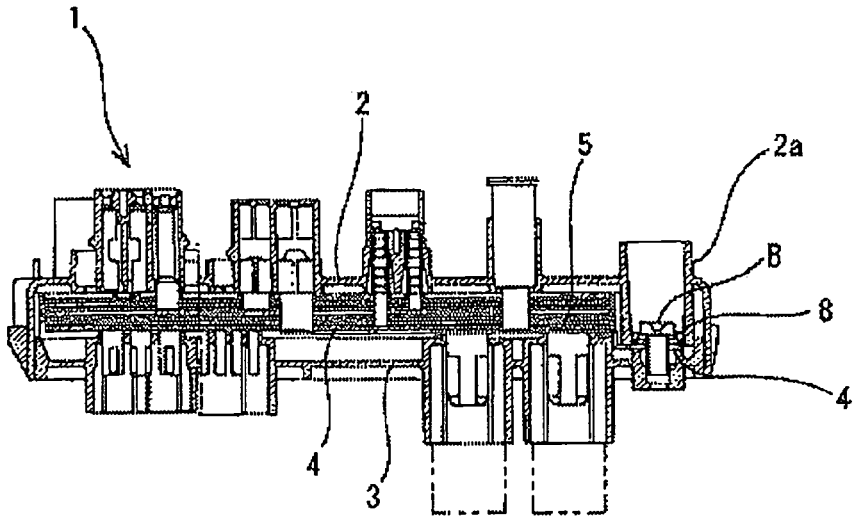
FIG. 11B PRIOR ART
FIG. 11B is a longitudinal section view of the junction box taken along line I2—I2 in FIG. 11A.
Figure 12:
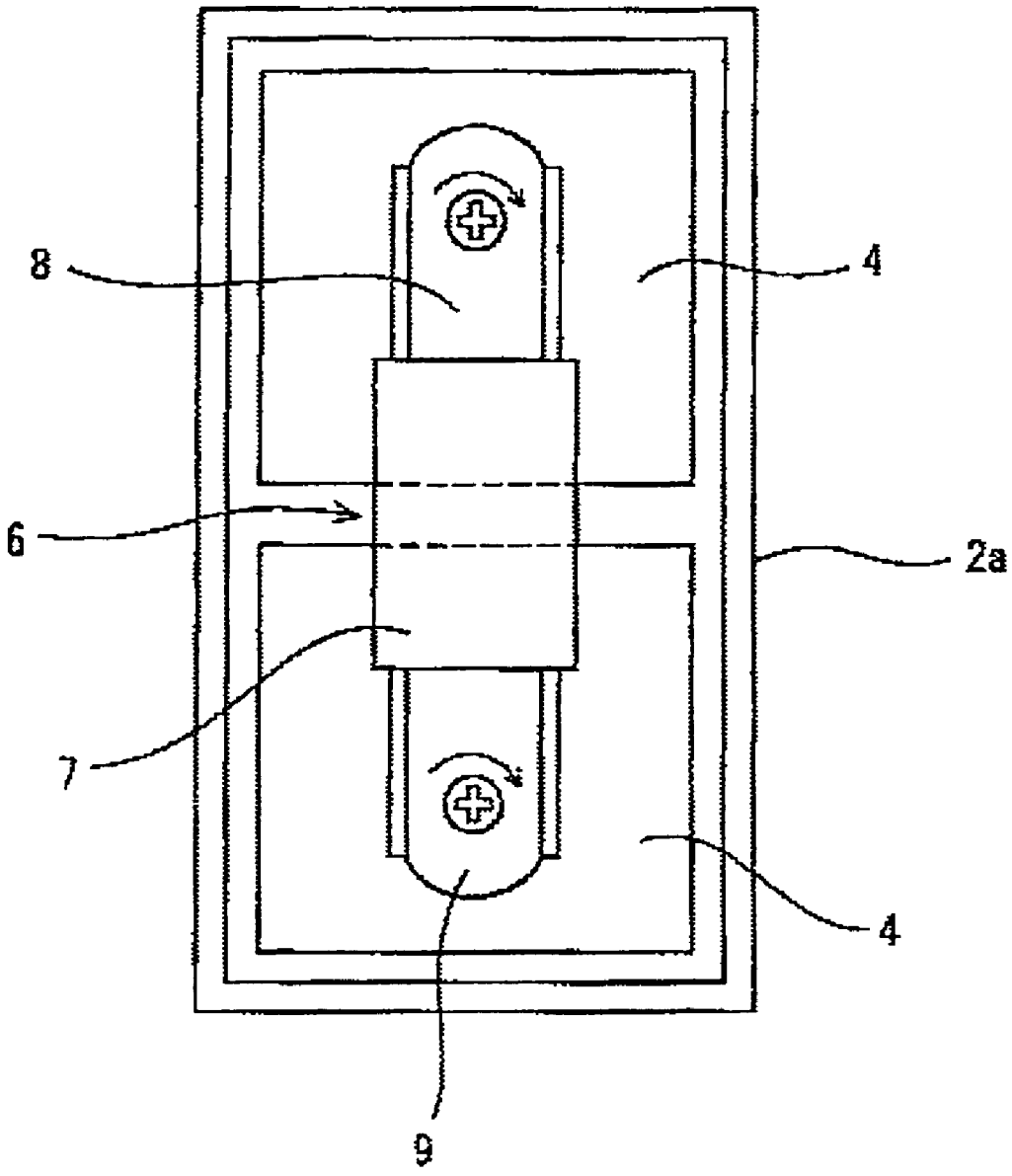
FIG. 12 PRIOR ART
FIG. 12 is a plan view of another conventional fusible link.

As shown in FIGS. 10A and 10B, the fusible links 55 and 56 to be accommodated in the electrical junction box 40 in the third embodiment include input and output terminals 55*a*, 56*a* and 55*b*, 56*b* projecting horizontally from the opposite sides of the link bodies 55*c* and 56*c*, respectively. Narrow fusible portions 55*d* and 56*d* interconnect the input terminals 55*a*, 56*a* and the output terminals 55*b*, 56*b* in the link bodies 55*c*, 56*c*. The narrow fusible portions 55*d* and 56*d* are disposed on the same plane as the input and output terminals 55*a*, 56*a* and 55*b*, 56*b*.

The other end of the input side bus bar 51 is connected to a battery terminal 61. The battery terminal 61 is pressed onto and connected to a distal end of an electrical wire w1 of an electrical power source. An arcuate portion 61*a* is engaged with a battery post 71 projecting upward from the battery box 70 and they are fixed on each other by bolts B and nuts N.

The bolt 52*b* is provided on the other end of the output side bus bar 52. A terminal 62 pressed onto and connected to an output electrical wire w2 is engaged with the bolt 52*b* and fixed by the nut N. Similarly, the bolt 53*b* is provided on the other end of the output side bus bar 53. A terminal 63 pressed onto and connected to an output electrical wire w3 is engaged with the bolt 53*b* and fixed by the nut N.

According to the above structure, since the U-bend portions 42 projecting from the casing body 41 contact with the side edges of the input and output terminals 55*a*, 56*a* and 55*b*, 56*b* of the fusible links 55 and 56, it is possible for the U-bend portions 42 to prevent rotary movements of the input and output terminals 55*a*, 56*a* and 55*b*, 56*b* of the fusible links 55 and 56 when securing the input and output terminals 55*a*, 56*a* and 55*b*, 56*b* to the bus bars 51, 52, 53 and also to prevent breakage of the terminals contacting with the link bodies 55*c*, 56*c* of the fusible links 55, 56.

Also, the third embodiment utilizes the fusible links 55 and 56 in which the input and output terminals 55*a*, 56*a* and 55*b*, 56*b* and the fusible portions 55*d*, 56*d* are arranged on the same plane. However, as described above, since the U-bend portions 42 can prevent rotary movements of the input and output terminals 55*a*, 56*a* and 55*b*, 56*b*, it is possible to prevent breakage of the terminals and fusible portions.

Although the U-bend portions contact with the opposite sides of the input and output terminals in the third embodiment, the U-bend portions may contact with one side edge of the input terminal and the other side edge of the output terminal.

The entire disclosure of Japanese Patent Application Nos. 2003-427631 and 2004-247558 filed on Dec. 12, 2003 and Jul. 31, 2004 including the specifications, claims, drawings and summaries are incorporated herein by reference in their entireties.

While the present invention has been particularly described, in conjunction with specific preferred embodiments, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

What is claimed is:

1. An electrical junction box for a motor vehicle comprising: a casing; a pair of bus bars accommodated in and secured to said casing with the bus bars being exposed outward; and a fusible link having a link body, an input terminal and an output terminal that extend from the opposite sides of said link body, said input and output terminals being secured to said bus bars by bolts, respectively;

wherein said input and output terminals of said fusible link are provided on their opposite side edges with ribs, respectively and U-bend portions are provided on said bus bars to contact with outer side surfaces of said ribs, said U-bend portions being formed by folding parts of said bus bars.

2. An electrical junction box for a motor vehicle according to claim 1, wherein:

said U-bend portions each include a long leg, a short leg, and a bend that connects the long leg and the short leg, an end face of the short leg is in a plane that intersects a longitudinal axis of the short leg, and the end face of the short leg contacts with said ribs of said input and output terminals near positions where a longitudinal end of each of said ribs contacts with said link body of said fusible link.

3. An electrical junction box for a motor vehicle according to claim 2, wherein said U-bend portions of said bus bars contact either with one rib on one side edge of said input terminal and with the other rib on the other side edge of said output terminal, respectively or with both ribs on the opposite side edges of said input and output terminals.

4. An electrical junction box for a motor vehicle according to claim 2, further comprising a fusible link-containing section on the outer surface of said casing;

wherein said bus bars are provided with great area portions that engage with the inner surface of a peripheral wall of said fusible link-containing section, each of said U-bend portions is formed by folding a part extending from each of said great area portions onto each great area portion, said bus bars are provided with bolt holes, said fusible link-containing section is provided on the bottom wall with bolt holes, and nuts are previously fixed around said bolt holes on the rear side of said bottom wall of said fusible link-containing section;

wherein bolt holes provided in said input and output terminals of said fusible link, bolt holes in said bus bars, and bolt holes in said bottom wall are aligned coaxially with one another, a bolt is inserted into each set of said aligned bolt holes and fastened by a nut.

5. An electrical junction box for a motor vehicle according to claim 2, wherein said fusible link includes said input terminal, said output terminal, and fusible portions that interconnect said input and output terminals in said link body and said fusible portions are arranged on the same plane as said input and output terminals.

6. An electrical junction box for a motor vehicle according to claim 1, wherein said U-bend portions of said bus bars contact either with one rib on one side edge of said input terminal and with the other rib on the other side edge of said output terminal, respectively or with both ribs on the opposite side edges of said input and output terminals.

7. An electrical junction box for a motor vehicle according to claim 6, further comprising a fusible link-containing section on the outer surface of said casing;

wherein said bus bars are provided with great area portions that engage with the inner surface of a peripheral wall of said fusible link-containing section, each of said U-bend portions is formed by folding a part extending from each of said great area portions onto each great area portion, said bus bars are provided with bolt holes, said fusible link-containing section is provided on the bottom wall with bolt holes, and nuts are previously fixed around said bolt holes on the rear side of said bottom wall of said fusible link-containing section;

wherein bolt holes provided in said input and output terminals of said fusible link, bolt holes in said bus bars, and bolt holes in said bottom wall are aligned coaxially with one another, a bolt is inserted into each set of said aligned bolt holes and fastened by a nut.

8. An electrical junction box for a motor vehicle according to claim 6, wherein said fusible link includes said input terminal, said output terminal, and fusible portions that interconnect said input and output terminals in said link body and said fusible portions are arranged on the same plane as said input and output terminals.

9. An electrical junction box for a motor vehicle according to claim 1, further comprising a fusible link-containing section on the outer surface of said casing;

wherein said bus bars are provided with great area portions that engage with the inner surface of a peripheral wall of said fusible link-containing section, each of said U-bend portions is formed by folding a part extending from each of said great area portions onto each great area portion, said bus bars are provided with bolt holes, said fusible link-containing section is provided on the bottom wall with bolt holes, and nuts are previously fixed around said bolt holes on the rear side of said bottom wall of said fusible link-containing section;

wherein bolt holes provided in said input and output terminals of said fusible link, bolt holes in said bus bars, and bolt holes in said bottom wall are aligned coaxially with one another, a bolt is inserted into each set of said aligned bolt holes and fastened by a nut.

10. An electrical junction box for a motor vehicle according to claim 9, wherein said fusible link includes said input terminal, said output terminal, and fusible portions that interconnect said input and output terminals in said link body and said fusible portions are arranged on the same plane as said input and output terminals.

11. An electrical junction box for a motor vehicle according to claim 1, wherein said fusible link includes said input terminal, said output terminal, and fusible portions that interconnect said input and output terminals in said link body and said fusible portions are arranged on the same plane as said input and output terminals.

* * * * *